US006083889A

United States Patent [19]

Angelo et al.

[11] Patent Number: 6,083,889

[45] Date of Patent: Jul. 4, 2000

[54] HIGH TEMPERATURE, HIGH EFFICIENCY ELECTRICAL AND TRANSFORMER OIL

[75] Inventors: Jacob Ben Angelo, Spring, Tex.; Christopher Jeffrey Still Kent, Baton Rouge, La.

[73] Assignee: Exxon Research and Engineering Company, Florham Park, N.J.

[21] Appl. No.: 09/245,270

[22] Filed: Feb. 5, 1999

[51] Int. Cl.[7] ..... C10M 133/46

[52] U.S. Cl. ..... 508/281; 508/280; 508/584

[58] Field of Search ..... 508/281, 280, 508/584

[56] References Cited

U.S. PATENT DOCUMENTS

| | | | |
|---|---|---|---|
| 4,880,551 | 11/1989 | Doe . | |
| 4,931,196 | 6/1990 | Payne et al. . | |
| 5,032,300 | 7/1991 | O'Neil . | |
| 5,167,847 | 12/1992 | Olavesen et al. | 252/50 |

FOREIGN PATENT DOCUMENTS

| | | | |
|---|---|---|---|
| 0497467A1 | 8/1992 | European Pat. Off. | C10M 101/02 |
| 0499359A1 | 8/1992 | European Pat. Off. | C10M 101/02 |
| 1215001 | 12/1970 | United Kingdom | C10M 3/26 |
| WO93/02165 | 2/1993 | WIPO | C10M 141/06 |

OTHER PUBLICATIONS

Hackh's Chemical Dictionary, Fourth Edition, McGraw–Hill, Inc. p. 684, 1969.

*Primary Examiner*—Jerry D. Johnson
*Attorney, Agent, or Firm*—Joseph J. Allocca

[57] ABSTRACT

An oil composition useful as an electrical or transformer oil is provided. The composition comprises a major amount of a paraffinic oil having a Cleveland open cup flash point of more than about 200° C. and an effective amount of an additive system including at least one hindered phenolic antioxidant and a tolyltriazole metal deactivator.

6 Claims, No Drawings

HIGH TEMPERATURE, HIGH EFFICIENCY ELECTRICAL AND TRANSFORMER OIL

FIELD OF THE INVENTION

This invention relates generally to electrical and transformer oils and more particularly to electrical oils suitable for use in transformers operating at elevated temperatures.

BACKGROUND OF THE INVENTION

Present commercial practice is to use conventional naphthenic transformer oils in transformers designed to operate under normal use at a maximum oil temperature of 90° C. with an expected life in the range of about 20 to about 30 years. By operating a transformer at elevated oil temperatures of about 140° C., more kilowatts of power can be generated at a higher load. Unfortunately, the conventional naphthenic transformer oils that are used in present commercial transformers have poor oxidation stability at this higher temperature and through oil oxidation become incompatible with the materials of construction of the transformer, thus significantly shortening the transformer life. Accordingly, there is a need for a transformer oil having an extended useful life at significantly higher temperatures than present oils.

One object of the invention is to provide improved electrical and transformer oils which have low solvency for materials of construction at top oil temperatures of about 140° C.

Another object of the invention is to provide electrical and transformer oils that have improved oxidation stability at top oil temperatures greater than about 140° C.

Another object of the invention is to provide an additive system which will impart exceptional chemical and oxidative stability to the oil and maintain the high efficiency of the transformer by not adversely affecting the power factor.

Another object of the invention is to provide electrical and transformer oils that have a negative gassing tendency.

These and other objects of the invention will become apparent upon a reading of the description which follows.

SUMMARY OF THE INVENTION

Briefly stated, an oil composition is provided comprising a major amount of a paraffinic oil having a Cleveland open cup flash point of more than about 200° C. and an effective amount of an additive system including:

(i) at least one hindered phenolic antioxidant, and (ii) a tolyltriazole metal deactivator.

The composition is especially useful as an electrical and transformer oil.

DETAILED DESCRIPTION OF THE INVENTION

The composition of the present invention utilizes a major amount of a paraffrnic oil having a Cleveland open cup flash point more than about 200° C. An example of such an oil is a solvent refined 145N paraffinic basestock sold by Exxon Corporation, Dallas, Tex.

Such an oil has lower solvency and better compatibility with seal and gasket materials than do naphthenic oils.

Compatibility with seal and gasket materials has been generally found to correlate with the aniline point of the oil, with oils that have higher aniline points being more gasket and seal compatible than those with lower aniline points.

The additive system of the present invention includes (i) at least one hindered phenol antioxidant, and (ii) a metal deactivator.

Typical hindered phenolic antioxidants suitable in the compositions of the present invention may be represented by formula I and formula II:

I

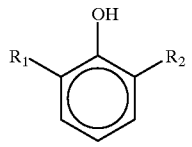

II

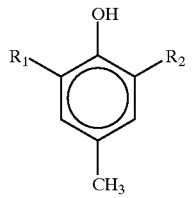

where $R_1$ and $R_2$ may be the same or different alkyl groups, especially branched alkyl groups, containing 3 to about 9 carbon atoms. Preferred phenolic antioxidants include 2,6 di-tert-butylphenol, 2,6 di-tert-butylparacresol and mixtures thereof.

The additive system also includes a tolyltriazole metal deactivator such as 1,2,3 tolyltriazole. Preferably the tolyltriazole used is a reaction product of a tolyltriazole and an alkylated diphenyl amine. A typical tolytriazole diphenyl amine reaction product may be represented by the formula III:

III

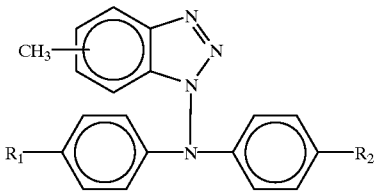

wherein $R_1$ and $R_2$ may be the same or different alkyl groups having from about 3 to about 15 and preferably about 4 to about 9 carbon atoms.

In general, the additive system in the composition is present in a minor but effective amount. For example, the hindered phenol or mixtures thereof typically will comprise from about 0.05 to about 3.0 wt. % based on the weight of the paraffinic oil, and preferably 0.5 wt. % to 2.0 wt. %. The metal deactivator typically will comprise from about 0.01 to about 1.5 wt. %, based on the weight of the paraffinic oil, and preferably from about 0.10 to 1.0 wt. %. The pour point depressant will comprise from about 0.10 to about 1.0 wt. %, based on the weight of paraffinic oil and preferably from 0.4 to 0.8 wt. %.

Finally, the composition of the present invention may also include optional additives such as a pour point depressant capable of lowering the pour point to below the lowest temperature expected for the climate in which the electrical oil is to be used. This would normally be a temperature of −30° C. to −40° C. A particularly preferred class of pour point depressants is alkylated polystyrenes. Other illustrative pour point depressants include methacrylates and fumeric acid esters.

Alternatively, this low temperature performance can be provided through the use of a dewaxed paraffinic oil having a Cleveland open cup flash point greater than about 200° C.

EXAMPLE 1

An electrical and transformer oil was formulated using the base oil a Solvent Neutral 145N paraffinic basestock having a Cleveland open cup flash point of 220° C. This Solvent Neutral 145N is commonly referred to as 145 SSU @ 100° F. paraffinic stock. The formulation contained 2,6 di-tert-butyl phenyl, 2,6 di-tert-butyl cresol and tolyltriazole diphenyl amine in the amounts shown in Table 1. The formulated oil was tested for life using the ASTM D 2112 Rotary Bomb Test and for oxidation stability using the ASTM D 2440 test. The results are shown in Table 2.

TABLE 1

FORMULATION FOR EXAMPLE 1

| COMPONENT | CONCENTRATION, WT % |
|---|---|
| Solvent Neutral 145 | 98.45 |
| Tolyltriazole diphenyl amine | 0.30 |
| 2,6, di-tert-butyl phenol | 0.75 |
| 2,6, di-tert-butyl paracresol | 0.50 |

Comparative Example 1

The ASTM specification for a Type II oil are presented as Comparative Example 1 in Table 2.

Comparative Example 2

In the properties of a commercially available transformer oil are shown in Table 2 as Comparative Example 2.

TABLE 2

| DESCRIPTION | ASTM TEST METHOD | EXAMPLE 1 | | COMPARATIVE EXAMPLE 1 ASTM D 3487 Type II Oil | COMPARATIVE EXAMPLE 2 | |
|---|---|---|---|---|---|---|
| Physical Properties | | | | | | |
| Specific Gravity, 60/60° F. | D 1298 | 0.866 | | 0.91 max | 0.870 | |
| Viscosity @ 40° C., cSt | D 88, D 445 | 29.21 | | 12.0 max | 7.9 | |
| Viscosity @ 100° C., cSt | D 88, D 445 | 5.10 | | 3.0 max | 2.2 | |
| Viscosity @ 100° F., SSU | D 88, D 445 | 150.9 | | 66 max | 53.5 | |
| Viscosity @ 210° F., SSU | D 88, D 445 | 43.4 | | 36 max | 33.5 | |
| Aniline Point, ° C. | D 611 | 103 | | 63–84 | 74 | |
| Pour Point, ° C. | D 97 | −18 | | −40 max | −54 | |
| Color, ASTM | D 1500 | L0.5 | | 0.5 max | L0.5 | |
| Flash Point (COC), ° C. | D 92 | 220 | | 145 min | 158 | |
| Sulfur, wt % | X-ray | 0.12 | | — | 0.12 | |
| Neut Number, mg KOH/g | D 974 | 0.0 | | 0.03 max | 0.0 | |
| Water by KF, ppm | D 1533 | 27 | | 30 max | 20 | |
| Interfacial Tension @ 25° C., dynes/cm | D 971 | 47 | | 40 | 49 | |
| Chemical Properties | | | | | | |
| Corrosive Sulfur | D 1275 | Noncorrosive | | Noncorrosive | Noncorrosive | |
| Antioxidant Content, mass % | D 2668, D 1473 | 1.25 | | 0.30 max | 0.25 | |
| Oxidation Stability @ 72 Hours: | D 2440 | 110° C. | 130° C.(1) | 110° C. | 110° C. | 130° C.(1) |
| Sludge, wt % | | 0.068 | 0.080 | 0.10 max | 0.01 | — |
| Neutralization No., mgKOH/g | | 0.022 | 0.077 | 0.30 max | 0.02 | — |
| 164 Hours: | | | | | | |
| Sludge, wt % | | 0.124 | 0.006 | 0.20 max | 0.01 | 0.47 |
| Neutralization No., mgKOH/g | | 0.022 | 0.173 | 0.40 max | 0.08 | 0.73 |
| 336 Hours: | | | | | | |
| Sludge, wt % | | 0.086 | 0.096 | — | 0.12 | 0.76 |
| Neutralization No., mgKOH/g | | 0.067 | 0.714 | — | 0.37 | 0.90 |
| Oxidation Stability Rotary Bomb Life, Minutes @ | D 2112 | | | | | |
| 140° C. | | 851 | | 195 | 300 | |
| 150° C.(2) | | 488 | | — | — | |
| 160° C.(3) | | 345 | | — | 116 | |
| Electrical Properties | | | | | | |
| Dielectric Breakdown Voltage @ 60 Hertz, KV | D 877 | 61 | | 30 min | 47 | |

TABLE 2-continued

| DESCRIPTION | ASTM TEST METHOD | EXAMPLE 1 | COMPARATIVE EXAMPLE 1 ASTM D 3487 Type II Oil | COMPARATIVE EXAMPLE 2 |
|---|---|---|---|---|
| Impulse Breakdown Voltage @ 25° C., KV | | | | |
| Needle (negative) - to-sphere (grounded), @ 1-in Gap | D 3300 | 144 | 145 min | 175 |
| Power Factor @ 60 Hertz, % @ | D 924 | | | |
| 25° C. | | 0.004 | 0.05 max | 0.005 |
| 90° C. | | 0.280 | — | — |
| 100° C. | | 0.460 | 0.30 max | 0.120 |
| Gassing Tendency @ 80° C., μL/minute | D 2300B | −2.8(4) | +30 max | −11.0 |
| Static Charge Density, μC/m³ | none | 20 | 50 max | 5 |

Note:
(1)Test was modified to increase severity by increasing temperature from 110° C. to 130° C.
(2)Test was modified to increase severity by increasing temperature from 140° C. to 150° C.
(3)Test was modified to increase severity by increasing temperature from 140° C. to 160° C.
(4)The Gassing Tendency of the base oil without the additive system exhibits a positive gassing tendency of +16 μL/minute.

EXAMPLES 3 to 5

Three oils were formulated with the additive system of this invention. The composition of each is given in Table 3. The formulated oils were tested using the ASTM Rotary Bomb Test and ASTM Test D2440. The results are shown in Table 3.

Comparative Examples 3 to 5

Three oils were formulated using only one of the components of the additive system of this invention. These compositions are given in Table 3. The oils were also tested as in Examples 3 to 5 and the results are presented in Table 3.

TABLE 3

EFFECT OF ANTIOXIDANT COMBINATIONS ON OXIDATION STABILITY

| | Comparative Examples | | | Examples | | |
|---|---|---|---|---|---|---|
| | 3 | 4 | 5 | 3 | 4 | 5 |
| Component, wt. % | | | | | | |
| Tolyltriazole diphenyl amine (TTDPA) | 1.55 | — | — | 0.30 | 0.30 | 0.30 |
| 2,6 di-tert-butyl phenol (DTBP) | — | 1.55 | — | 1.25 | — | 0.75 |
| 2,6, di-tert-butyl paracresol (DBPC) | — | — | 1.55 | — | 1.25 | 0.50 |
| Solvent Neutral 145 | 98.45 | 98.45 | 98.45 | 98.45 | 98.45 | 98.45 |
| Oxidation Stability | | | | | | |
| ASTM D2440 Oxidation @ 130° C. | | | | | | |
| 164 Hours, Sludge, wt. % | 0.108 | 0.008 | 0.010 | 0.005 | 0.003 | 0.060 |
| Neut. No., mg KOH/g | 0.447 | 0.048 | 0.420 | 0.075 | 0.091 | 0.173 |
| 336 Hours Sludge, wt. % | 0.217 | 0.322 | 0.553 | 0.085 | 0.085 | 0.054 |
| Neut. No., mg KOH/g | 0.559 | 1.170 | 1.628 | 0.615 | 0.674 | 0.629 |
| Rotary Bomb Oxidation Test @ 160° C., Minutes | 335 | 290 | 150 | 437 | 256 | 345 |

As can be seen from the data in Table 3, the additive system of the present invention is better than the phenolic inhibitor or metal deactivator alone in lowering the level of sludge formed during oxidation. Also, the additive system of the invention provides better oxidation stability as determined in the Rotary Bomb Oxidation Test.

Examples 6 and 7

The oils were formulated, each containing the additive system of the invention. The formulations are given in Table 4. The power factor for each formulation also was determined. As is known, the power factor is a measure of how much energy is absorbed by the insulating oil when placed in an alternating electric field such as would be found in a transformer. High power factors result in lower electrical efficiency as well as shorter transformer life. The measured power factors are given in Table 4.

Comparative Examples 6 and 7

Two additional oil formulations were prepared using the same base oil as in Examples 6 and 7, i.e., Solvent Neutral 145, the same phenolic antioxidants but a benzotriazole metal deactivator. The compositions are given in Table 4. The power factors for these compositions was determined and are also given in Table 4.

TABLE 4

EFFECT OF METAL DEACTIVATOR ON ELECTRICAL PROPERTIES

| | Comparative Example 6 | Example 6 | Comparative Example 7 | Example 7 |
|---|---|---|---|---|
| Component, wt. % | | | | |
| Solvent Neutral 145 | 99.55 | 99.50 | 99.1 | 99.00 |
| 2,6 di-tert-butyl paracresol | 0.12 | 0.12 | 0.24 | 0.24 |
| 3,5 di-tert-butyl-4-hydroxyhydorcinnamic acid, C 7-9-branched | 0.12 | 0.12 | 0.24 | 0.24 |
| Nonylated diphenylamine | 0.16 | 0.16 | 0.32 | 0.32 |
| N,N-bis (2-Ethylhexyl)-ar-methyl-1H-benzotriazole-1-methanamine | 0.05 | — | 0.10 | — |
| Tolytriazole diphenylamine(1) | — | 0.10 | — | 0.20 |
| Power Factor, % @ | | | | |
| 25° C. | 0.028 | 0.009 | 0.036 | 0.016 |
| 90° C. | 3.70 | 1.46 | 4.80 | 2.40 |
| 100° C. | 5.20 | 1.74 | 7.00 | 3.30 |

Note:
(1)50% actives in base oil.

As can be seen the additive system of this invention results in an oil formulation having a power factor about half of that obtained in oil formulations using a conventional metal deactivator.

What is claimed is:

1. An oil composition comprising:

a major amount of a paraffinic oil having a Cleveland open cup flash point of more than about 200° C., and a minor amount of an additive system including (i) at least one hindered phenolic anti-oxidant, and (ii) a tolyltriazole diphenyl amine having the formula

III

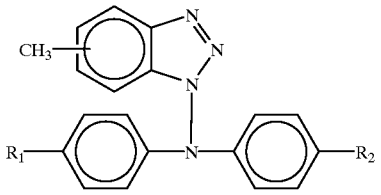

wherein $R_1$ and $R_2$ are the same or different alkyl groups of from about 3 to about 15 carbon atoms.

2. The composition of claim 1 wherein the hindered phenol is selected from phenols having the formula:

I

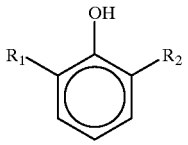

-continued

II

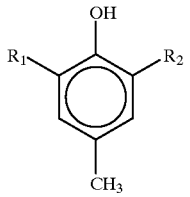

where $R_1$ and $R_2$ may be the same or different alkyl groups having 3 to about 9 carbon atoms.

3. The composition of claim 1 wherein the hindered phenolic antioxidant comprises from about 0.05 to about 3.0 wt. % based on the weight of the paraffinic oil.

4. The composition of claim 3 wherein the tolyltriazole metal deactivator comprises from about 0.10 to about 1.0 wt. % based on the weight of the paraffinic oil.

5. The composition of claim 4 including a pour point depressant in an amount ranging from about 0.05 to about 3.0 wt. % based on the weight of paraffinic oil.

6. The composition of claim 4 wherein the paraffinic oil is a dewaxed oil.

* * * * *